US011536075B2

(12) United States Patent
Soderqvist

(10) Patent No.: US 11,536,075 B2
(45) Date of Patent: Dec. 27, 2022

(54) DOOR OPERATOR AND METHOD OF ITS OPERATION

(71) Applicant: Assa Abloy Entrance Systems AB, Landskrona (SE)

(72) Inventor: Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 20 days.

(21) Appl. No.: 17/259,865

(22) PCT Filed: Aug. 8, 2019

(86) PCT No.: PCT/EP2019/071289
§ 371 (c)(1),
(2) Date: Jan. 12, 2021

(87) PCT Pub. No.: WO2020/030728
PCT Pub. Date: Feb. 13, 2020

(65) Prior Publication Data

US 2021/0222476 A1 Jul. 22, 2021

(30) Foreign Application Priority Data

Aug. 9, 2018 (SE) ..... 1830237-2

(51) Int. Cl.
*E05F 11/24* (2006.01)
*E05F 15/63* (2015.01)
*E05F 1/10* (2006.01)

(52) U.S. Cl.
CPC ..... *E05F 15/63* (2015.01); *E05F 1/105* (2013.01); *E05F 2015/631* (2015.01);
(Continued)

(58) Field of Classification Search
CPC ..... E05Y 15/63; E05Y 15/616; E05Y 1/105; E05Y 1/10; E05Y 2015/631;
(Continued)

(56) References Cited

U.S. PATENT DOCUMENTS 4,222,147 A 9/1980 Burnett
4,339,843 A 7/1982 Burnett
(Continued)

FOREIGN PATENT DOCUMENTS

DE 102016200632 7/2017

OTHER PUBLICATIONS

International Search Report in PCT/EP2019/071289 dated Nov. 12, 2019.

(Continued)

*Primary Examiner* — Jerry E Redman
(74) *Attorney, Agent, or Firm* — Wissing Miller LLP

(57) ABSTRACT

A swing door operator for moving a door leaf between an open and a closed position is described, the swing door operator including at least one drive unit that has a motor and a spring, the motor and spring being arranged to interact to enable moving the swing door leaf between the open and closed positions. The swing door operator also has a control unit that is operatively connected to the drive unit and thereby to the motor and that controls different modes of door operation.

10 Claims, 4 Drawing Sheets

(52) U.S. Cl.
CPC ..... *E05Y 2400/33* (2013.01); *E05Y 2400/45* (2013.01); *E05Y 2900/132* (2013.01)

(58) Field of Classification Search
CPC ..... E05Y 2400/33; E05Y 2400/45; E05Y 2900/132; E05Y 2800/113
USPC ..... 49/139, 140, 339, 340, 345
See application file for complete search history.

(56) References Cited

U.S. PATENT DOCUMENTS

| | | | | |
|---|---|---|---|---|
| 4,952,080 | A | 8/1990 | Boiucaner et al. | |
| 5,687,507 | A | 11/1997 | Beran | |
| 5,878,530 | A | 3/1999 | Eccleston et al. | |
| 5,913,763 | A | 6/1999 | Beran et al. | |
| 6,891,479 | B1 * | 5/2005 | Eccleston | E05F 15/63 340/545.1 |
| 7,316,096 | B2 * | 1/2008 | Houser | E05F 15/63 49/340 |
| 8,225,458 | B1 * | 7/2012 | Hoffberg | E05F 3/102 16/84 |
| 8,407,937 | B2 * | 4/2013 | Houser | E05F 15/63 49/346 |
| 9,995,076 | B1 * | 6/2018 | Hoffberg | E05F 3/10 |
| 10,208,520 | B2 * | 2/2019 | Long | G01L 3/242 |
| 10,480,236 | B2 * | 11/2019 | Söderqvist | E05F 15/63 |
| 10,808,445 | B2 * | 10/2020 | Hucker | E05F 5/027 |
| 10,837,212 | B2 * | 11/2020 | Hucker | E05F 1/1253 |
| 11,072,965 | B2 * | 7/2021 | Soderqvist | E05F 1/006 |
| 11,199,041 | B2 * | 12/2021 | Yulkowski | E05F 15/00 |
| 2006/0244271 | A1 | 11/2006 | Hass | |
| 2009/0265992 | A1 | 10/2009 | Haas et al. | |
| 2014/0325911 | A1 * | 11/2014 | Hass | E05F 15/611 49/31 |
| 2016/0060941 | A1 * | 3/2016 | Ingham | E05F 15/63 49/340 |
| 2018/0066467 | A1 * | 3/2018 | Da Deppo | B60R 11/04 |

OTHER PUBLICATIONS

Swedish Search Report in Swedish Pat. Appl. No. 1830237-2, dated Mar. 6, 2019.

* cited by examiner

DOOR OPERATOR AND METHOD OF ITS OPERATION

This application is a 371 of PCT/EP2019/071289 filed on Aug. 8, 2019, published on Feb. 13, 2020 under publication number WO 2020/030728, which claims priority benefits from Swedish Patent Application No. 1830237-2, filed on Aug. 9, 2018, the disclosure of which is incorporated herein by reference.

TECHNICAL FIELD

The present invention relates to a swing door operator and a method for set up and operation of a swing door operator.

BACKGROUND ART

Automatic door sets are regulated by standards, which define requirements on how a door operator should function in different situations, including pedestrian protection requirements for door sets. These regulations define, e.g., maximum kinetic energy, maximum closing force, opening and closing time, and use of safety sensors.

These regulations were also created in order assure that a fire door closes in a correct manner in case of an emergency. Further, to fulfil these requirements the door operators need to be very robust and to be able to close or open a fire door even in an unpowered state. Further, at different applications/positions there is a need that the doors are kept in an open position, i.e. for instance at a hospital where the night watch need to watch several patients in different rooms at the same time. However, in case of emergency it is important that the door is opened or closed. There is thus a need for that a swing door operator could be used to open or close a door in the event of an emergency and at the same time allow the door opening to be as large as possible.

SUMMARY OF THE INVENTION

On this background, it is an object of the present invention to provide a door operator, which solves or at least mitigates the problems above.

Another object of the invention is to provide a door operator that fulfil all of the requirements above and ultimately makes the use of associated doors easier, and less cumbersome and more effortless for a user, while the door operator still is very adaptable and flexible without being too complex making its use more versatile.

Yet an object of the invention is to provide a door operator that provides both an automatic or autonomous operation mode of a swing door leaf for easy passage of pedestrians and a free swing mode of the door leaf for applications when the door should be used as a door without automatic operation and that is opened or closed in an emergency situation. In a free swing mode, a pedestrian exerts a force on the door leaf manually to move it between an open or closed position or vice versa without any resistance of the drive system used for the automatic operations.

Any or all of the above objects are achieved by means of a swing door operator for moving a door leaf between an open and closed position, as claimed in the associated independent claim, preferred variants thereof being defined in the associated dependent claims.

According to a first aspect of the present invention, any or all of these objects are achieved by a swing door operator for moving a door leaf between an open and closed position, the swing door operator comprising at least one drive unit that comprises at least one motor and at least one spring, the motor and spring being arranged to interact to enable moving the swing door leaf between the open and closed position, the swing door operator further comprising a control unit being operatively connected to the drive unit and thereby the motor, wherein the control unit: in a first mode is configured to regulate the drive unit to move the swing door leaf between the open and closed position, and, in a second mode is configured to control the motor of the drive unit to counteract the force of the spring, such that the swing door leaf is configured to be moved in a free swing mode.

Further objects and features of the present invention will appear from the following definitions of aspects/examples/embodiments of the invention.

According to an aspect of the swing door operator, the control unit is configured to, in the second mode, to regulate the motor of the drive unite to counteract the force of the spring by exerting a force on the swing door leaf that is equal to in size and opposite to in direction to the biasing force of the spring.

According to another aspect of the swing door operator, the control unit in the second mode is configured to detect any external force urging the swing door leaf in any direction, and in response to this detection is configured to control the drive unit to operate the motor to counteract the biasing force of the spring as long as the external force is affecting the swing door leaf.

According to yet an aspect of the swing door operator, the control unit comprises a memory and the swing door operator further comprises one or more sensors and an user interface, wherein the control unit is operatively connected to the user interface, the drive unit and/or at least one sensor to be able to control the drive unit in response to input in the user interface and/or signals from the sensor, so that the motor is able to counteract the force from the spring in accordance with the user interface input and/or signals from the sensor autonomously between the open and closed position in the second mode of the control unit.

According to still an aspect of the swing door operator, the control unit in its second mode is adapted to control the motor in response to detection of any external force urging the swing door leaf in any direction, whereby the motor is operated to counteract only the biasing force of the spring when any external force is impacting/affecting the swing door leaf.

According to one more aspect of the swing door operator, the detection and/or measurement and registering of the force/torque of the motor required to bias the spring, while moving the swing door leaf without the swing door leaf being affected by any external force, in its memory, is achieved in cooperation with at least one internal and/or external sensor measuring the current drawn by the motor.

According to another aspect of the swing door operator, the at least one internal and/or external sensor is at least one built-in sensor of the motor.

According to a further aspect of the swing door operator, the first mode of the control unit is initiated via the user interface to set up the door operator, and the second mode of the control unit is initiated via the user interface after completion of the first mode.

According to still an aspect of the swing door operator, the second mode of the control unit is configured to initiate/activate and perform autonomous operation of the door operator in cooperation with at least one sensor.

According to another aspect of the swing door operator, the control unit in its first mode is adapted to regulate the drive unit to operate the motor to swing the swing door leaf in one direction without the swing door leaf being urged in any direction by means of an external force while the spring is biased, and, at the same time, is adapted to detect/measure and register the force/torque of the motor required to bias the spring while swinging the swing door leaf without the swing door leaf being impacted/affected by the external force, in its memory.

According to an aspect of the swing door operator, the motor is an electric motor.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant, "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Aspects of the present disclosure will be described more fully hereinafter with reference to the accompanying FIGS. 1 to 8. The assembly and method disclosed herein can, however, be realized in many different forms and should not be construed as being limited to the aspects set forth herein.

The terminology used herein has the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operators for different types of door sets and door leafs. More specifically, the invention relates to door operators for one or more swing door sets and the functionality of each swing door operator for operating the swing door operator and/or using it. Furthermore, the present invention relates to a door operator system that comprises one or more such door operators connected to one or more swing door leafs, and such a system for any type of swing door leaves, e.g. made up of one or more sections or halves being swingable about a separate or common axis.

Figure 1:
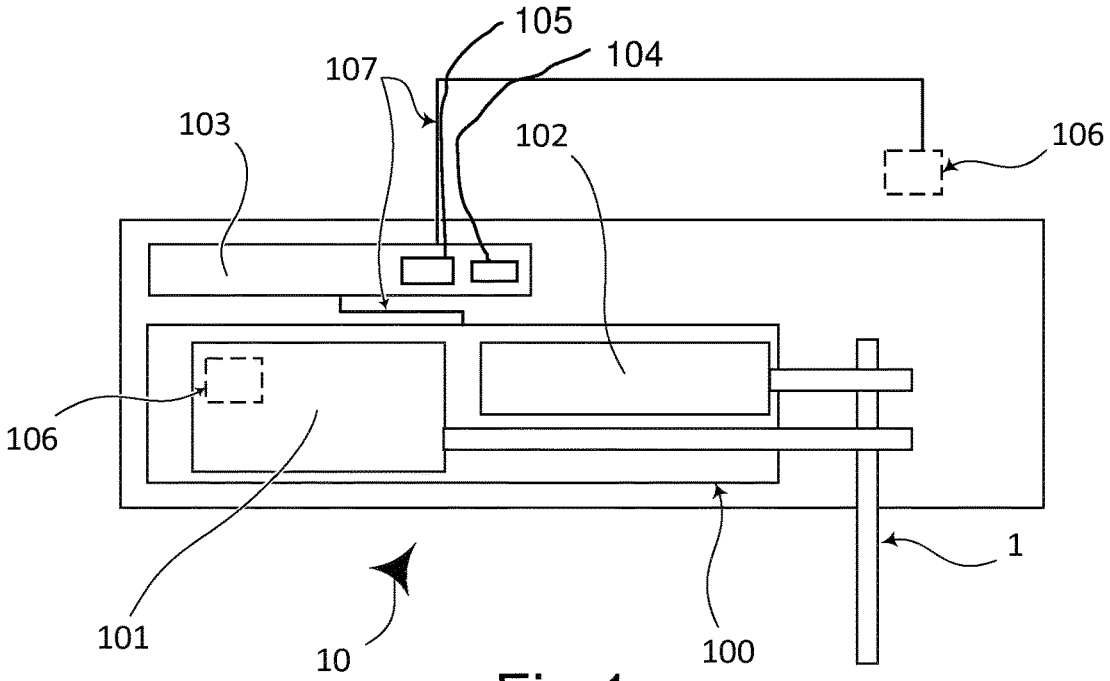
FIG. 1 shows a schematic view of a swing door operator according to an aspect of the present invention.
Figure 2:
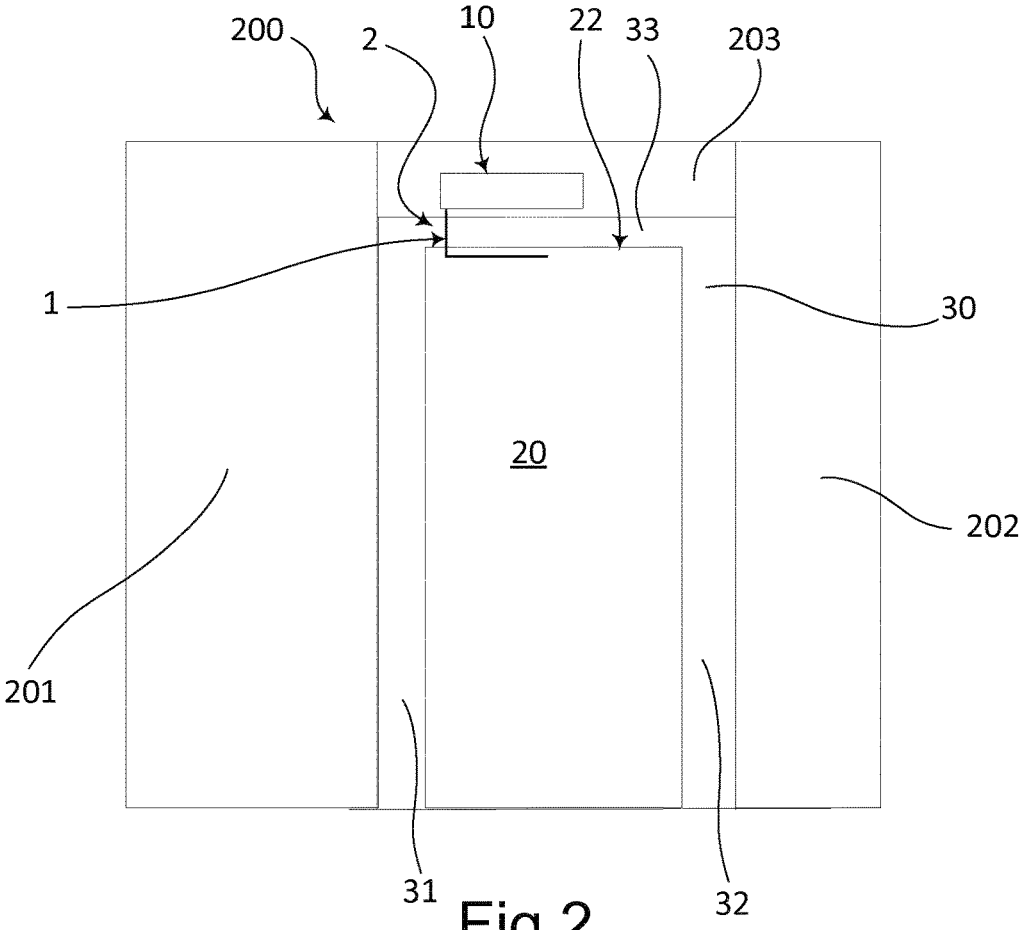
FIG. 2 shows a schematic view of a swing door operator system comprising one door leaf and one swing door operator according to an aspect of the present invention.

In FIG. 1, a swing door operator 10 is disclosed according to an aspect of the invention. In FIG. 2 a first swing door operator system 200 is disclosed according to the invention and in FIG. 3 a second swing door operator system 300 is disclosed according to the invention.

Figure 3:
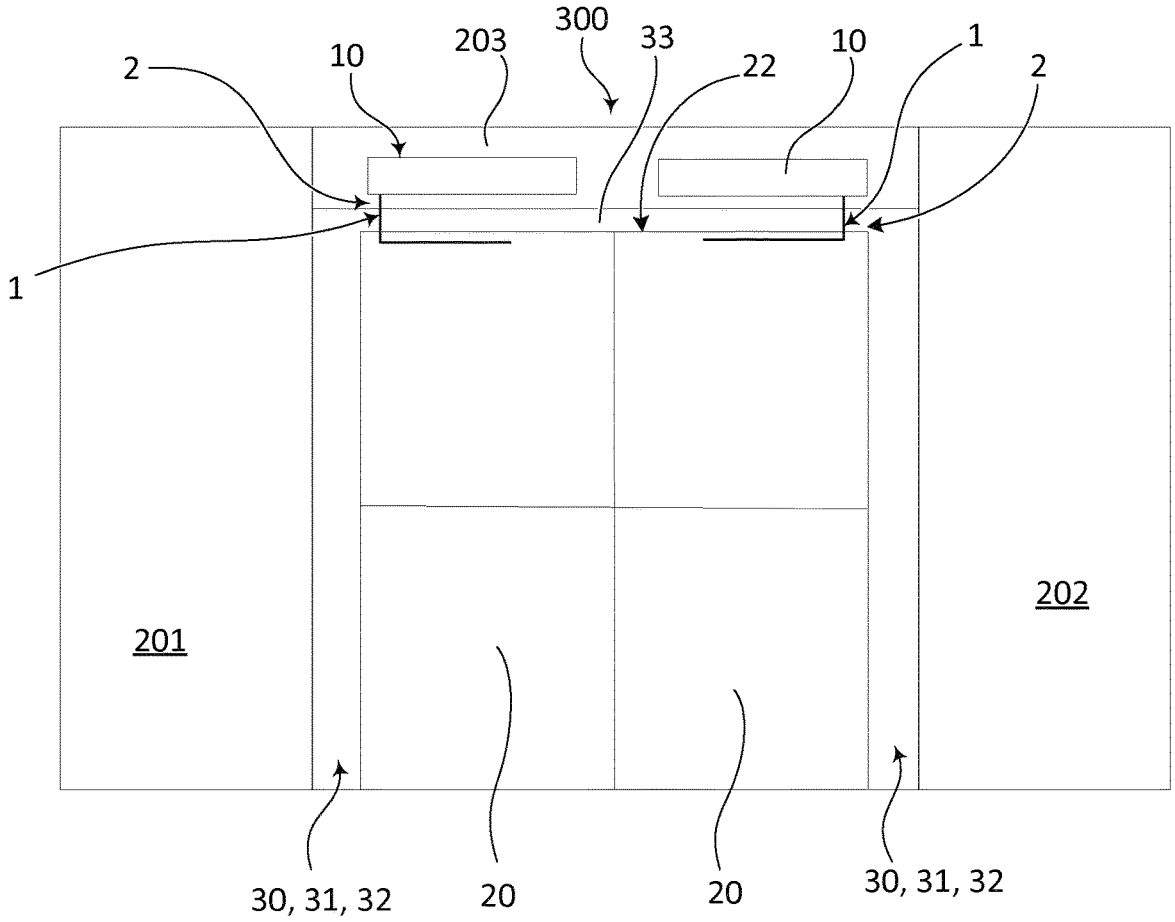
FIG. 3 shows a schematic view of a swing door operator system comprising two swing door leafs and one swing door operator for each swing door leaf according to an aspect of the present invention.

In FIGS. 2 and 3, the first and second swing door operator systems 200 and 300 are disclosed according to an aspect of the invention. The first swing door operator system 200 comprises a swing door operator 10, at least one wall section 201, 202, 203, a door frame 30, 31, 32, 33 and a swing door leaf 20. The second swing door operator system 300 comprises two swing door operators 10, at least one wall section 201, 202, 203, a door frame 30, 31, 32, 33 and two swing door leaves 20. A swing door operator system 200, 300 is located in buildings to be a part of a system, e.g. to restrict the effect of a fire in an emergency situation. The system should work in an emergency situation even if there is a power outage and the system should be able to either close a swing door leaf 20 to close a fire cell or to open a swing door leaf 20 to keep an escape route open.

A swing door operator system 200, 300 generally refers to a system having one or two swing door leafs 20, i.e. a single leaf swing door operator system 200, as disclosed in FIG. 2, 4-8 or a double leaf swing door operator system 300 as disclosed in FIG. 3, where each swing door leaf is hinged or pivoted to the door frame 30, 31, 32, 33 via a hinge 21 at one or more of its edges. Each swing door leaf 20 has a main opening/closing edge, arranged opposite to the hinge/pivot edge. In other words, the main opening/closing edge refers to the edge of a swing door leaf 20 whose distance from a parallel, opposing edge or surface determines the usable opening of the swing door leafs 20. The opposing opening/closing edge refers to either an edge formed by the main opening/closing edge of a counter closing swing door leaf, or a fixed edge or a surface towards which the swing door leaf is moving, such as a door frame 30, 31, 32, 33.

In some aspects, one or more of the door leaves 20 could be divided into sections that are individually or commonly hinged to each other and/or the door frame 30, 31, 32, 33, see the divided door leaves 20 in FIG. 3 visualised by a horizontal line extending at the middle portion of each door leaf 20 and along both leaves, however, if only one door leaf 20 is divided into sections, only one of the door leaves 20 in FIG. 3 would be divided by a horizontal line.

When the first swing door operator system 200 is provided with only one swing door leaf 20, the swing door leaf is hinged or pivoted via a hinge 21 at one edge 22 to the door frame 30, 31, 32, while the main opening/closing edge of the swing door leaf closes against, and preferably locks with, the corresponding edge of the door frame 30.

When the second swing door operator system 300 is provided with two swing door leafs 20, the second swing door operator system 300 may comprise two identical swing door leafs 20, arranged side by side with their respective opening/closing edges in close proximity to each other when both door leafs 20 are in the closed position.

In addition, the swing door operator system 200, 300 may comprise a master door leaf 20, provided with a flange extending along its main opening/closing edge, and a slave door leaf 20. The flange of the master door leaf 20 is adapted to protrude over the main opening/closing edge of the slave door leaf 20, when both door leafs 20 are in the closed position. With such an arrangement, the door leafs 400 can be pushed open in one direction only, preferably from the inside of a room or building in a direction outwards towards the exterior, a corridor, or an evacuation route. The main opening/closing edge of the master door leaf 20 closes against, and preferably locks into, an opposing opening/closing edge, i.e. the main opening/closing edge, of the slave door leaf 20.

The swing door operator 10 of the swing door operator system 200, 300 as disclosed in FIG. 1, comprises a drive unit 100, a a motor 101, a spring 102, a control unit 103, a memory 104 (in the control unit), and optionally an user interface 105 for operation/control, either being wirelessly accessible and/or by wiring, for manual operation and/or automatic. The drive unit 100 is also operatively and/or physically connected to an axle 1, an arm system 2 comprising one or more arms 3, 3A, 3B and/or an arm guide 4. The swing door operator 10 according to an aspect comprise further components, such as a battery (not disclosed) and one or more different sensors 106 and one or more cable connections 107 between associated parts for operational control of them. These components as such are known in the art and will not be described in detail herein, but as an example, a sensor 106 could be built-in in the motor 101/control unit 103 or be externally arranged, see FIG. 1 showing one sensor 106 in dashed lines at the motor 101 and/or another sensor 106 at one end of the axle 1. The sensor 106 could also be a light or movement detector arranged to detect pedestrians and being operatively connected to the control unit 103 by cables 107 or even wirelessly, i.e. the other sensors 106 could also be wirelessly connected to the control unit 103.

The drive unit 100 is connected to the control unit 103. The drive unit 100 comprises a spring 102 and a motor 101. The drive unit 100 could further comprise a gearbox (not disclosed). The drive unit 100 is adapted to be connected to the door leaf 20 via the axle 1 and the arm system 2 and to move the door leaf between an open and closed position, i.e. from an open position to a closed position and from a closed position to an open position. In FIGS. 2 and 3, the door leaf/-s 20 is/are shown in closed or nearly closed position, either just before closing, after closing or during opening or closing or when closed, while FIGS. 4 to 8 shows the door leaf/-s 20 during closing or opening or when in a standby mode/position or still stand according to the functionality of the invention, i.e. the door leaf/-s 20 are shown between the end or closed position and fully open position, hence, the size of the door opening could be larger or smaller but not zero as visualised by an angle $\alpha$ in FIGS. 5 and 7. The motor 101 and the spring 102 are connected to the axle 1. The motor 101 and the spring 102 are arranged to interact to rotate the axle 1. The spring 102 is according to an aspect a torsion spring 102. According to one aspect the spring 102 is winded around the axle 1. According to an aspect the axle 1 is connected to the drive unit 100 and extends downwards from the drive unit 100. According to an aspect the axle 1 is positioned on one side of the drive unit 100. According to an aspect the axle 1 is positioned on one side of the motor 101 and the spring 102.

The spring 102 are moved/compressed by the motor 102 when it is moving the door leaf 20 in one direction and the motor 101 and the spring 102 together moves the door leaf 20 in the opposite direction. In this way the spring 102 always have stored energy to move the door leaf 20 back to a starting position. This position could be either the open position or the closed position.

The axle 1 is in one end connected to the drive unit 100. The axle 1 is connected to both the motor 101 and the spring 102. The axle 1 is in the other end connected to the arm system 2. When the axle 1 is rotated by the drive unit 100 it also rotates and moves the arm system 2, 3, 3A, 3B. According to an aspect the swing door operator 10 is mounted to the wall 201, 202, 203 such that the axle 1 is positioned as close as possible to the door leaf 20.

According to an aspect each swing door operator 10 is arranged to close each door leaf 20 in case of an emergency. In such an arrangement the spring 102 of the swing door operator 10 is tensioned and arranged to store energy when the door leaf 20 is moved from the closed position to the open position by the motor 101, i.e. in the first and/or the second swing door operator systems 200, 300. In this way, each spring 102 always has the energy to move the door leaf 20 from the open position to the closed position, even if the power to the motor 101 is cut.

The control unit 103 of the first and/or the second swing door operator systems 200, 300 controls when the drive unit/-s 100 should move the door leaf 20 between the open and closed position and how it should move it. The speed pattern/trajectory that the control unit 103 controls the drive unit/-s 100 to move the door leaf 20 along comprise information of one or more of which speeds the door leaf should be moved, its acceleration, its braking, the opening time, for how long the door should be open and/or the closing speed etc. The control unit 103 is arranged to store different speed trajectories and control the drive unit 100 to move the door leaf 20 along different trajectories.

The swing door operator 10 according to an aspect of the invention is adapted for moving the door leaf 20 between an open and closed position. The swing door operator 10 comprises at least one drive unit 100 that comprises at least one motor 101 and at least one spring 102. The motor 101 and spring 102 being arranged to interact to enable moving the swing door leaf 20 between the open and closed position. The moving of a swing door leaf 20 means swinging it in any direction, i.e. around a rotary or pivot axis as a hinge 21 extending horizontally or vertically or in any inclination there between. In some aspects, the swing door leaf 20 is made in two or more different parts or sections that each is adapted to be moved or swinged around an axis being a common axis for all these separate swing door leaf sections or a separate axis for each door leaf section. The control unit 103 is in a first mode configured to regulate the drive unit 100 to move the swing door leaf 20 between the open and closed position. The control unit 103 is in a second mode configured to control the motor 101 of the drive unit 100 to counteract the force of the spring 102, such that the swing door leaf is configured to be moved in a free swing mode.

A free swing mode is defined as a mode where a swing door leaf 20 is possible to move in any direction without any other resistance than the weight of the door leaf 20 and/or any friction in and between associated moving parts, e.g. at the hinge 21 and/or any arm system 2 and/or arms 3, 3A, 3B. Hence, a free swing mode for a swing door leaf 20 means that the swing door leaf is movable as if no automatic was present at all, i.e. as a door without automatic and even having no door operator 10. In the free swing mode, it is possible to move the door freely between any position, including the closed and open position, and also into any position and leave it or let it be in that position, e.g. more or less open.

In one aspect of the swing door operator 10, the control unit 103 is configured to, in the second mode, to regulate the motor 101 of the drive unite 100 to counteract the force of the spring 102 by exerting a force on the swing door leaf 20 that is equal to in size and opposite to in direction to the biasing force of the spring 102. This enable the free swing mode as the spring 102 then in principle is disconnected in a forcibly way, i.e. the spring is tensioned but the counter action of the motor 101 makes the force of the spring "non-acting" on the swing door leaf 20 making it more or less weightless when manually handled.

Hence, in another aspect of the swing door operator 10, the control unit 103 in the second mode is configured to detect any external force (denoted Fext in FIGS. 4 to 8 as a dashed double arrow visualising that the external force may urge the door leaf in any direction, e.g. by pulling or pushing on the handle 23 of FIGS. 4 and 6 or directly on any side of the door leaf 20 as in FIGS. 5, 7 and 8) urging the swing door leaf 20 in any direction, and in response to this detection is configured to control the drive unit 100 to operate the motor 101 to counteract the biasing force of the spring 102 as long as the external force is impacting or affecting the swing door leaf, i.e. if no external force is detected as impacting or affecting the swing door leaf 20, the drive unit 100 still operate the motor 101 to counteract the biasing force of the spring 102 to create the free swing mode of the door leaf 20 while still achieving the automatic mode if any sensor 106 detects that a pedestrian pushes a button to open the swing door 20 automatically without manually pushing the swing door leaf with an external force Fext. Hence, the swing door leaf 20 could be in any position after being moved manually by a pedestrian into that position, e.g. the swing door leaf 20 could be manually opened in its free swing mode by being pushed by a pedestrian with an external force Fext until a certain angle $\alpha$ is of door opening is achieved (see FIGS. 5 and 7) and then when this angle is reached the pedestrian lets go of the swing door leaf 20 and the swing door leaf stays or is maintained/withheld in this position by itself in a standstill position until an external force Fext anew is applied onto the swing door leaf to move it into another position and/or a sensor 106 detects an input from a button or light detector that the swing door leaf is to be opened or closed.

In yet one aspect of the swing door operator 10, the control unit 103 comprises at least one memory 104 and the swing door operator 10 comprises one or more sensors 106 operatively connected to the user interface 105, wherein the control unit is operatively connected to the user interface, the drive unit 100 and/or at least one sensor to be able to control the drive unit in response to input in the user interface and/or signals from the sensor, so that the drive unit is able to move the swing door leaf 20 in accordance with the user interface input and/or signals from the sensor autonomously between the open and closed position in the second mode of the control unit.

The swing door operator 10 according to one aspect comprises the control unit 103 in its second mode being adapted to control the motor 101 in response to detection of any external force Fext urging the swing door leaf 20 in any direction, whereby the motor is operated to counteract only the biasing force of the spring 102 when any external force is impacting or affecting the swing door leaf.

According to an aspect, the detection and/or measurement and registering of the force and/or torque of the motor 101 required to bias the spring 102, while moving the swing door leaf 20 without the swing door leaf being affected by any external force Fext, in its memory 104, is achieved in cooperation with at least one internal and/or external sensor 106. In one aspect, the at least one internal and/or external sensor 106 is at least one built-in sensor of the motor 101. In the swing door operator 10 according to yet an aspect, the first mode of the control unit 103 is initiated via the user interface 105 to set up the door operator 10, and the second mode of the control unit is initiated via the user interface after completion of the first mode. Hence, the first mode may be utilized as a predefined standard mode of operation which is set up by the service personnel upon installing the swing door operator. The second mode may thus be possible to set up by the end user. The user requirements may vary greatly depending on the environement wherein the swing door operator is installed, whereby having the second mode being able to be set up by the end user is particularly advantegous. Thus, a swing door operator which is easier to adapt to user requirements is achieved.

In one aspect of the swing door operator 10, the second mode of the control unit 103 is configured to initiate and/or activate and perform autonomous operation of the door operator 10 in cooperation with at least one sensor 106. In still one aspect of the swing door operator 10, the control unit 103 in its first mode is adapted to regulate the drive unit 100 to operate the motor 101 to swing the swing door leaf 20 in one direction without the swing door leaf being urged in any direction by means of the external force Fext while the spring 102 is biased, and, at the same time, is adapted to detect/measure and register the force and/or torque of the motor required to bias the spring 102 while swinging the swing door leaf 20 without the swing door leaf being impacted or affected by the external force, in its memory 104. In yet an aspect of the swing door operator 10, the motor 101 is an electric motor.

According to an aspect the drive unit 100 is arranged to apply different trajectories based on how the swing door operator 10 is mounted in relation to the door leaf 20. The control unit 103 is according to some aspects connected to different sensors 106 and auxiliary systems (not shown) and arranged to control the drive units 100 based on received information from the sensors and systems. According to an aspect the control unit 103 is connected to an alarm system. According to another aspect the control unit 103 is connected to a fire alarm system.

Figure 4:
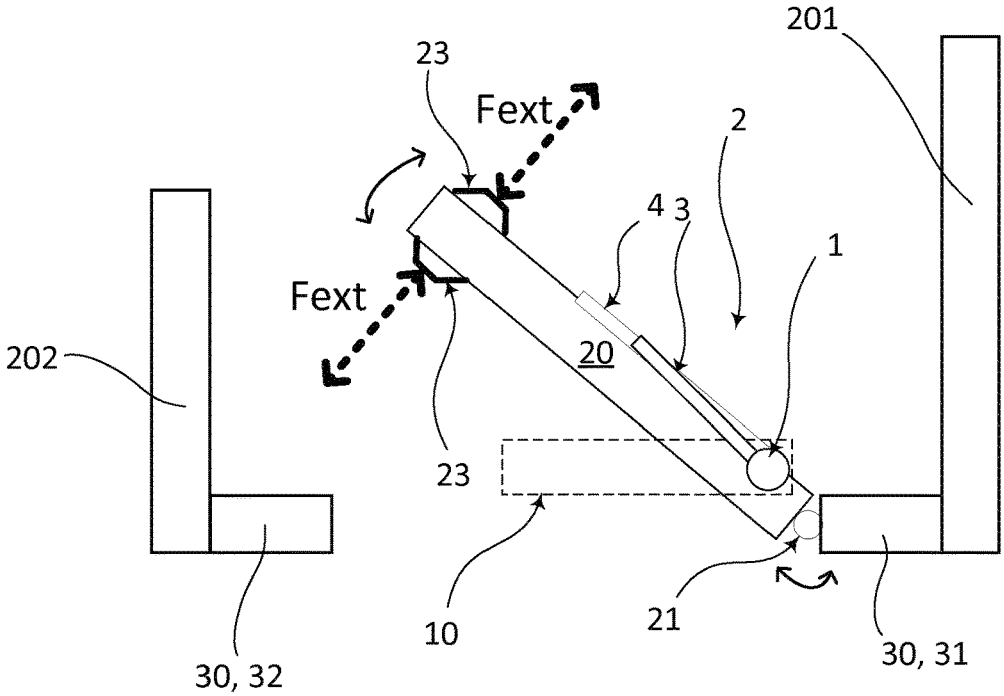
FIG. 4 shows a schematic top view of a swing door operator system comprising one corridor mounted swing door operator for pull application connected to a swing door leaf according to an aspect of the invention.
Figure 5:
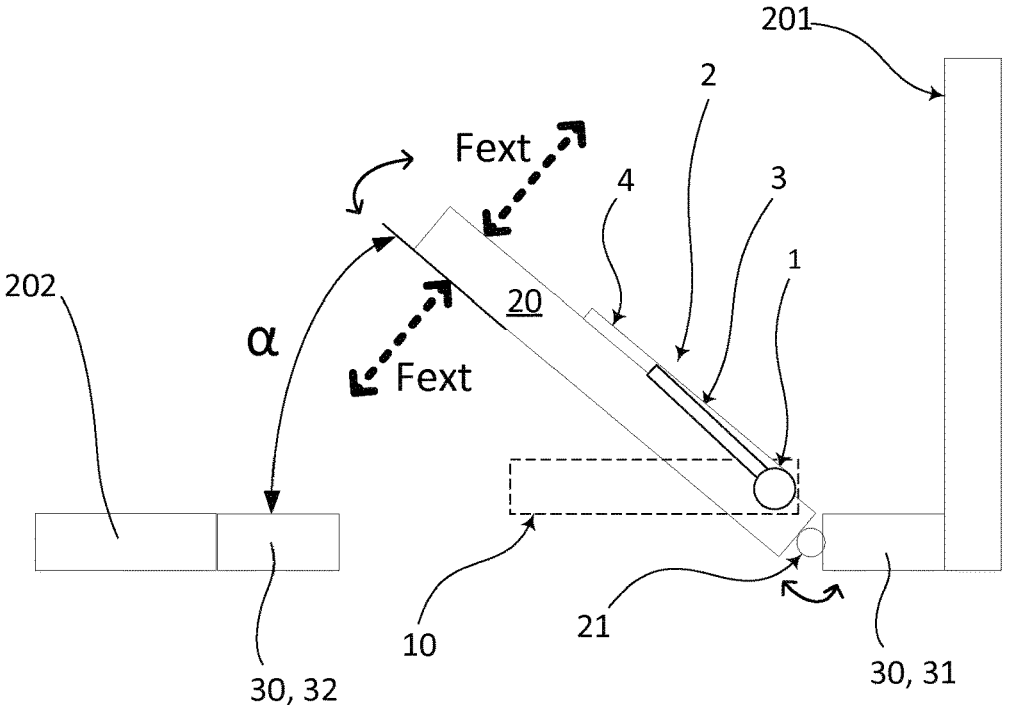
FIG. 5 shows a schematic top view of a swing door operator system comprising one corner mounted swing door operator for pull application connected to a swing door leaf according to an aspect of the invention.

In one aspect, the swing door leaf 20 comprises at least one handle 23. In another aspect, the swing door leaf 20 comprises two handles 23, see FIGS. 4 and 6. In yet one aspect, the swing door leaf 20 comprises at least one handle 23 at each of its sides, see FIGS. 4 and 6, but could also only have one handle on one side. The placement of the handle/-s 23 depend on the specific application and need of a pedestrian, but the major advantage is that the door leaf 20 thereby is easier to move in its free swing mode, and the position of the handle 23 also depends on in which direction the door leaf 20 is possible to move, however, the external force Fext exerted by a pedestrian is then also easier to transfer via a handle 23 if the door leaf is pulled towards the pedestrian, while it is easy to push the door leaf 20 without a handle. The swing door operator 10 of FIGS. 4, 5 and 7 is a pull swing door operator. The swing door operator 10 is connected to a first side of the door leaf 20 and mounted on a first wall side 201, however, in other aspects (not shown in FIGS. 4, 5, and 6 but in FIGS. 3, 7, and 8 for the double swing door version), the swing door operator 10 is connected to a second side of the door leaf 20 and/or mounted on a second wall side 202. The arm system 2 of the pull swing door operator 10 is according to an aspect a pull arm system 2, as disclosed in FIGS. 4, 5, and 7. The arm system 2 is in one end connected to the rotary axle 1. The arm system 2 is in its other end connected to the door leaf 20. The pull arm system 2 comprises an arm 3 and an arm guide 4. The arm 3 is in one end connected to the axle 1. The arm 3 is in the other end slidably connected to the arm guide 4. The arm guide 4 is mounted to the first side of the door leaf 20 facing the door operator 10. When the axle 1 is rotated by the drive unit 100, i.e. motor 101 and/or the spring 102, the arm 3 rotates together with the axle 1. As the arm 3 rotates, it pulls on the arm guide 4 and moves the arm guide 4 and at the same time the end of the arm 3 slides in the arm guide 4. The arm guide 4 is mounted on the first side of the door leaf 20 and as the arm 3 moves the arm guide 4 of the lonely door operator 10 exert a force on the door leaf 20 (this force from the arm 3 is not the external force Fext). When the axle 1 is rotated in the opposite direction, it will move the guide arm 4 and the door leaf 20 in the opposite direction. In this manner, the pull arm system 2 moves the door leaf 20 from the closed position to the open position and from the open position to the closed position. The length of the arm 3 and the arm guide 4 and the position of the arm guide 4 on the door leaf 2 are set in relation to the position of the swing door operator 10 in relation to the door leaf 20 and the geometry of the door leaf 20 and the placement of the wall 201. The bent arrows at the hinge 21 and the end or edge of the door leaf 20 opposite the edge being mounted to the hinge, i.e. the part of the door leaf that is furthest away from the door operator 10 visualises the movement of the door leaf 20 about the hinge both when moved in its free swing mode but also in its normal mode, i.e. the automatic mode.

Figure 6:
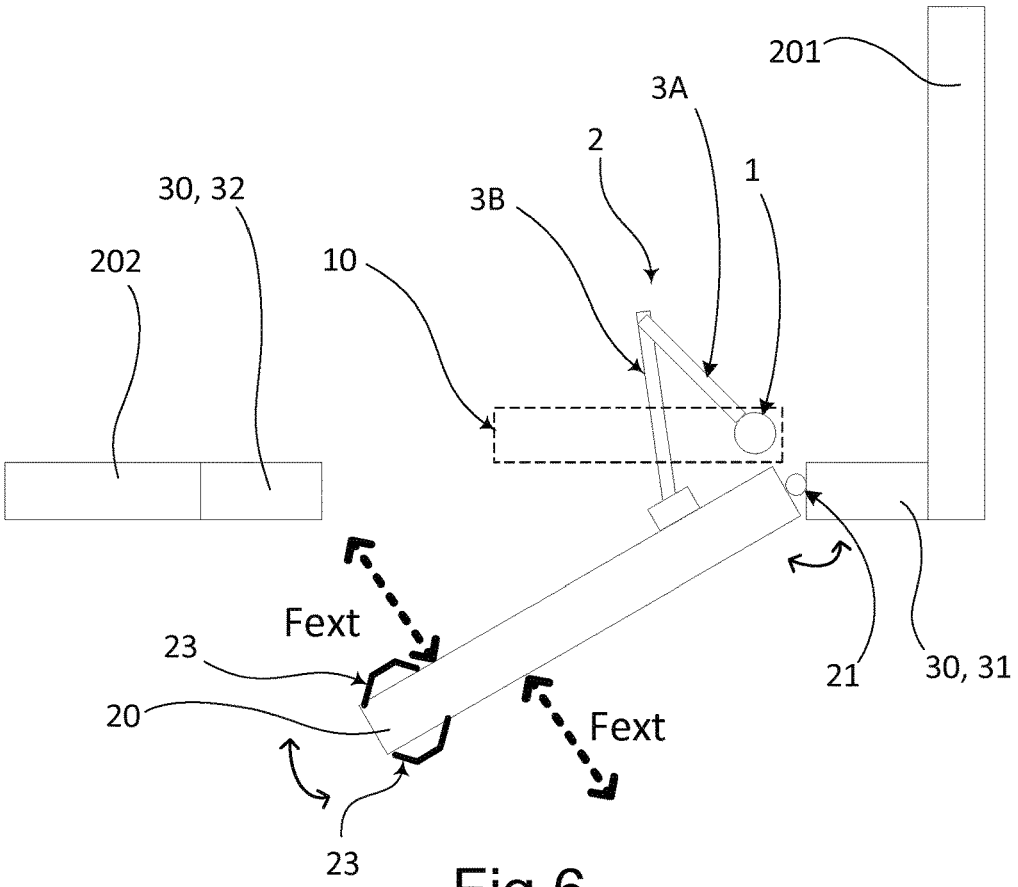
FIG. 6 shows a schematic top view of a swing door operator system comprising one corner mounted swing door operator for push application connected to a swing door leaf according to an aspect of the invention.
Figure 7:
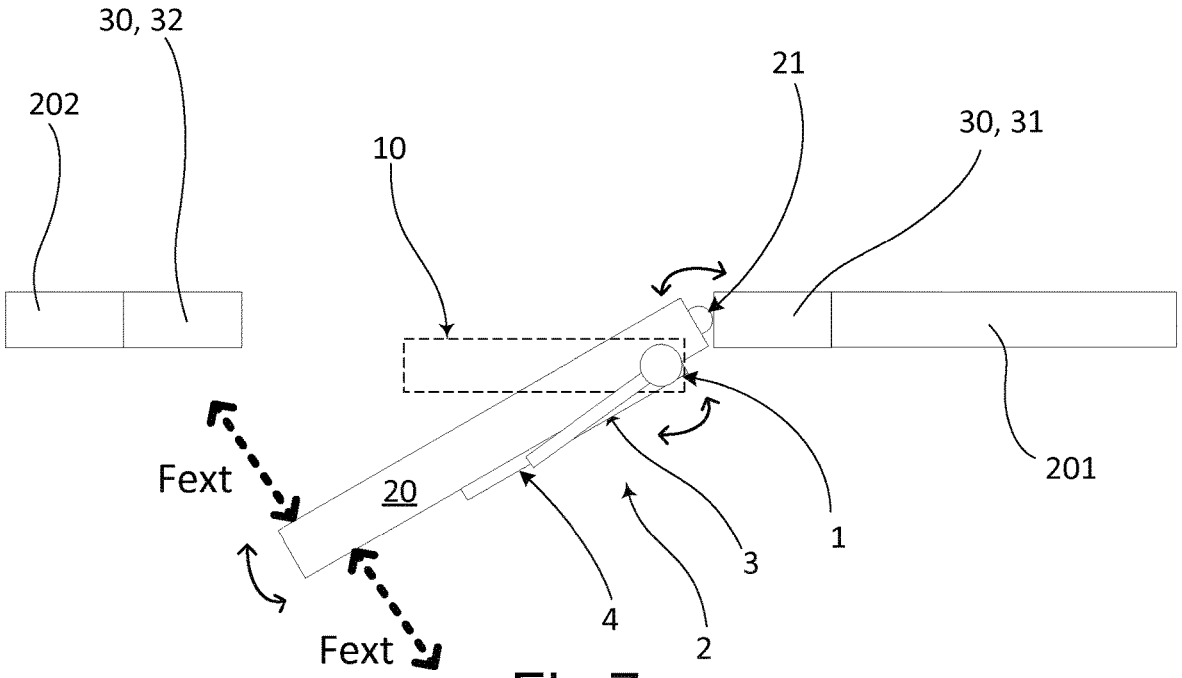
FIG. 7 shows a schematic top view of a swing door operator system comprising a one side mounted swing door operator for pull application connected to a swing door leaf at its other side compared to FIGS. 4 and 5 according to an aspect of the invention.
Figure 8:
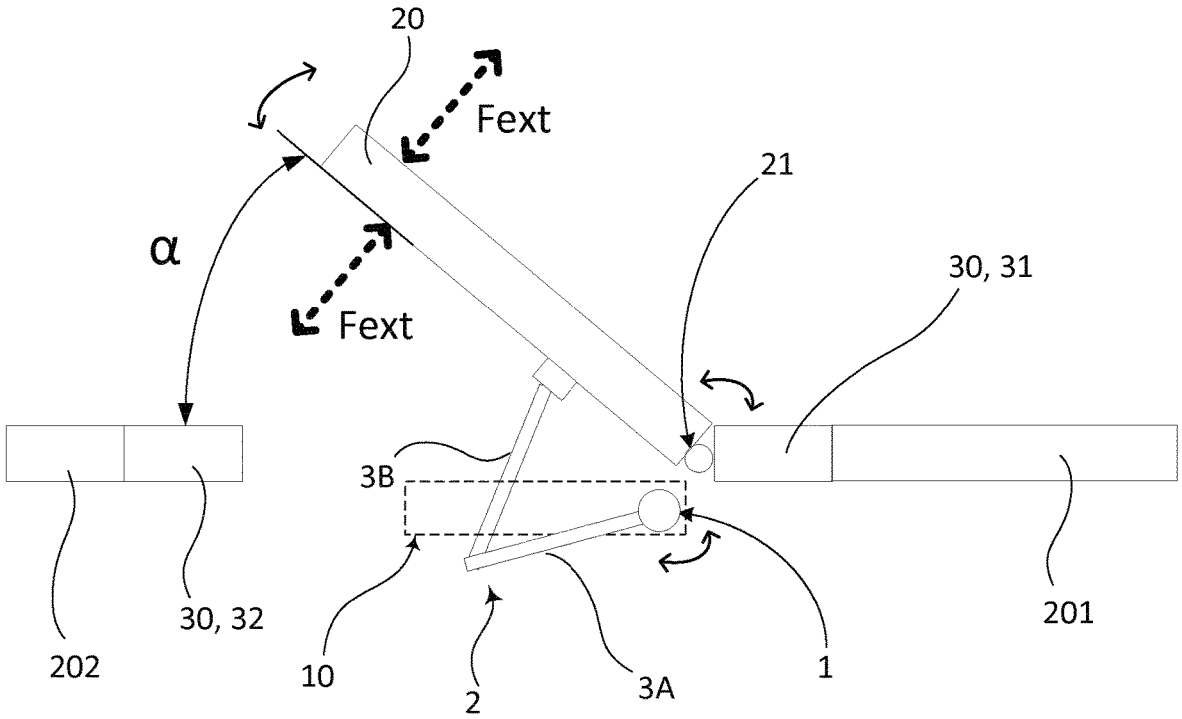
FIG. 8 shows a schematic top view of a swing door operator system comprising a one side mounted swing door operator for push application connected to a swing door leaf at its other side compared to FIG. 6 according to an aspect of the invention.

The swing door operator 10 in FIGS. 6 and 8 is according to an aspect a push swing door operator 10. The swing door operator 10 is according to an aspect connected to a first side or a second side of the door leaf 20 (here the first side) and mounted on a first 201 or a second side 202 of the wall (see also the pull version of FIGS. 4, 5 and 7). The arm system 2 of the push swing door operator 10 is according to an aspect a push arm system 2, as disclosed in FIGS. 6 and 8. The arm system 2 is in one end connected to the axle 1. The arm system 2 is in its other end connected to the first or second side of the door leaf 20. The second side is opposite to the first side of the door leaf 20. Put in another way, the first and second side is different sides of the door leaf 20 (compare the pull version of FIGS. 4, 5, and 7 with the push version of FIGS. 6 and 8). The pull arm system 2 comprises a first arm 3A and a second arm 3B. The first arm 3A is in one end connected to the axle 1. When the axle 1 is rotated by the drive unit 100, i.e. motor 101 and/or the spring 102, the first arm 3A rotates together with the axle 1. The first arm 3A is in the other end rotatable connected to an end of the second arm 3B. The second arm 3B is in the other end rotatable connected to the door leaf 20.

When the axle 1 is rotated by the drive unit 100, the first arm 3A rotates together with the axle 1. As the first arm 3A is rotated, it pushes the second arm 3B to move. When the second arm 3B is moved by the first arm 3A, it exerts a force on the door leaf 20 (this force from the arms 3A, 3B is not the external force Fext) and pushes on the door leaf 20. When moved, the second arm 3B is rotated in relation to the first arm 3A and the door leaf 20. When the axle 1 is rotated in the opposite direction by the drive unit 100 it will move the first arm 3A, the second arm 3B and the door leaf 20 in the opposite direction. In this manner, the push door operator 10 moves the door leaf 20 from the closed position to the open position and from the open position to the closed position. The length of the first arm 3A and the second arm 3B and the position of where the second arm 3B is connected to the first (or in some aspects the second) side of the door leaf 20 are set in relation to the position of the push swing door operator 10 in relation to the door leaf 20 and the geometry of the door leaf 20 and the placement of the door operator 10 on the wall 201.

There are a number of geometries and features that has to be taken into account when the arm system should be configured for pushing and/or pulling. One or more of the following aspects is taken into account, the distance from the axle 1 to the door leaf 20, the angle to which the door leaf 20 should be opened, the geometry of the door leaf 20, if the spring 102 should open or close the door leaf 20, and the weight of the door leaf.

Here, to enable the swing door operator 10 of the invention to work or be operated accordingly, a method is used for setup and then operation of the swing door operator 10 for moving at least one swing door leaf 20 between an open position and a closed position. The swing door operator 10 for moving a swing door leaf 20 relative a door frame 30 or one or more other swing door leafs 20 or swing door leaf sections and/or between an open and closed position and/or into any other position comprises at least one drive unit 100 that comprises at least one motor 101 and at least one spring 102. The motor 101 and spring 102 interact to enable moving the swing door leaf 20 being hingedly connected to the door frame 30. The door operator 10 further comprises an user interface 105 and at least one sensor 106 operatively connected to at least one control unit 103 and the swing door leaf 20, whereby the sensor 106 is configured to detect if any external force Fext, e.g. from a pedestrian trying to move the swing door leaf 20, is applied onto the swing door leaf. The control unit 103 is thereby able to control the motor 101 for swinging the swing door leaf 20 in response to detection by the sensor 106 and comprises a memory 104.

The method according to the invention comprises

- initiating a setup mode of the swing door operator 10 by means of the control unit 103 via the user interface 105,
- moving the swing door leaf 20 by operation of the drive unit 100 according to the set up mode without the swing door leaf 20 being affected by any external force Fext,
- driving the motor 101 accordingly while detecting and determining the spring force of the spring 102,
- registering the determined spring force of the spring 102 in the memory 104 of the control unit 103,
- initiating a second mode of operation of the swing door operator 10 via its user interface 105 after the set up mode is finished, and
- controlling the swing door operator 10 in the second mode of operation using the registered spring force of the spring 102 determined in the set up mode to regulate the motor 101 of the drive unit 100 to counteract the force of the spring 102, such that the swing door leaf 20) is movable in a free swing mode.

One aspect of the method uses the registered force of the spring 102 determined in the set up mode to control the swing door operator 10 in the second mode of operation such that if it is detected by the sensor 106 that any external force Fext is applied to the swing door leaf 20, the swing door leaf moves in response to the external force as if in free swing mode.

In some aspects of the method, operation of the drive unit 100 drives the motor 101 so that it moves the swing door leaf 20 biasing the spring 102, which function is used in the set up mode to determine the spring force in the spring.

In some aspect of the method, the determination of the spring force in the spring 102 is done by measuring the force/torque of the motor 101 and using the characteristics of the motor (gearing and torque constant) and the characteristics of the spring to calculate the spring force at different positions of the door leaf.

In some aspects of the method, the control unit 103, in the second mode, regulate the motor 101 of the drive unite 100 to counteract the force of the spring 102 by exerting a force on the swing door leaf 20 that is equal to in size and opposite to in direction to the biasing force of the spring.

In one aspect of the method, the control unit 103 in the second mode is set to detect any external force Fext urging the swing door leaf 20 in any direction, and in response to detection of an external force controls the drive unit 100 to operate the motor 101 to counteract the biasing force of the spring 102 as long as the external force is affecting the swing door leaf.

In another aspect of the method, the control unit 103 in its second mode controls the motor 101 in response to detection of any external force Fext urging the swing door leaf 20 in any direction, such that the motor counteract only the biasing force of the spring 102 when any external force is impacting/affecting the swing door leaf.

In yet an aspect of the method, the detection and/or measurement and registering of the force/torque of the motor 101 required to bias the spring 102, while moving the swing door leaf 20 without the swing door leaf being affected by any external force Fext, in its memory 104, is achieved in cooperation with at least one internal and/or external sensor 106.

The person skilled in the art realizes that the present invention by no means is limited to the preferred embodiments described above. On the contrary, many modifications and variations are possible within the scope of the appended claims. For example, a swing door set may comprise of more than two swinging door leafs, arranged in the same way as discussed above, e.g. hinged to the left or the right or at its upper or lower side if the door leaf is shaped as a parallelepiped and/or is to swing around/about an axis being vertical or horizontal and/or the swing door leafs, if more than one is used, could have different dimensions and/or shapes.

NOMENCLATURE

1 Axle
2 Arm system
3 Arm
3A First arm
3B Second arm
4 Arm guide
10 Swing door operator
20 Swing door leaf
21 Swing door leaf hinge
22 Edge of door leaf
23 Handle on door leaf
30 Door frame
31 Left vertical door frame element at the hinge side of the door leaf
32 Right vertical door frame element
33 Upper horizontal door frame element
100 Drive unit
101 Motor
102 Spring
103 Control unit
104 Memory in the control unit
105 User interface (UI)
106 Sensor (internal, e.g. built-in in the motor/control unit or external, e.g. light or movement detectors arranged to detect pedestrians and operatively connected to the control unit)
107 Cable connection between sensors and control unit and control unit and entities to be controlled such as drive unit, motor or the like
200 First swing door operator system
201 Left wall section
202 Right wall section
203 Upper wall section
300 Second swing door operator system
Fext: External force acting on one or more door leafs (i.e. a force not incurred by the motor or the spring, e.g. a force from a user manually forcing a door leaf or a section of it in the opening or closing direction)

The invention claimed is:

1. A swing door operator for moving a swing door leaf between an open and closed position, the swing door operator comprising:
at least one drive unit that comprises at least one motor and at least one spring, the motor and the spring being arranged to interact to enable moving the swing door leaf between the open and closed position;
a control unit being operatively connected to the drive unit and the motor,
wherein the control unit:
in a first mode regulates the drive unit to move the swing door leaf between the open and closed position, and
in a free swing mode detects an external force urging the swing door leaf in a direction, and in response to this detection controls the drive unit to operate the motor to counteract the biasing force of the spring at least as long as the external force is affecting the swing door leaf.

2. The swing door operator according to claim 1, wherein the control unit is configured to, in the free swing mode, regulate the motor of the drive unit to counteract the force of the spring by exerting a counteracting force on the swing door leaf that is equal to in size and opposite to in direction to the biasing force of the spring.

3. The swing door operator according to claim 1, wherein the control unit comprises a memory and the swing door operator further comprises one or more sensors and a user interface,
wherein the control unit is operatively connected to the user interface, the drive unit and at least one of the sensors to control the drive unit in response to an input in the user interface or signals from the sensor, so that the motor is able to counteract the force from the spring in accordance with the user interface input or signals from the sensor autonomously between the open and closed position in the free swing mode of the control unit.

4. The swing door operator according to claim 3, wherein the control unit in the free swing mode is adapted to control the motor in response to detection of an external force urging the swing door leaf in any direction, whereby the motor is operated to counteract only the biasing force of the spring when the external force is impacting/affecting the swing door leaf.

5. The swing door operator according to claim 4, wherein detection or measurement and registering of the counteracting force of the motor are required to bias the spring, while moving the swing door leaf without the swing door leaf being affected by the external force, in the memory, is achieved by at least one internal or external sensor measuring the current drawn by the motor.

6. The swing door operator according to claim 5, wherein the at least one internal or external sensor is at least one built-in sensor of the motor.

7. The swing door operator according to claim 3, wherein the first mode of the control unit is initiated via the user interface to set up the door operator, and the free swing mode of the control unit is initiated via the user interface after completion of the first mode.

8. The swing door operator according to claim 3, wherein the free swing mode of the control unit is configured to initiate/activate and perform autonomous operation of the door operator in cooperation with at least one sensor.

9. The swing door operator according to claim 3, wherein the control unit in the first mode is adapted to regulate the drive unit to operate the motor to swing the swing door leaf in one direction without the swing door leaf being urged in any direction by means of an external force while the spring is biased, and, at the same time, is adapted to detect/measure and register the counteracting force of the motor required to bias the spring while swinging the swing door leaf without the swing door leaf being impacted/affected by the external force, in its memory.

10. The swing door operator according to claim 1, wherein the motor is an electric motor.

* * * * *